United States Patent [19]

Kasagi

[11] 4,181,256

[45] Jan. 1, 1980

[54] METAL MELT-SPRAYING METHOD AND EQUIPMENT

[76] Inventor: Ryoichi Kasagi, No. 5-6, Minamitsukaguchi-cho, 1-chome, Amagasaki-shi, Hyogo-ken, Japan

[21] Appl. No.: 906,262

[22] Filed: May 15, 1978

[30] Foreign Application Priority Data

May 20, 1977 [JP] Japan ..... 52/59065

[51] Int. Cl.[2] ..... B05B 1/24

[52] U.S. Cl. ..... 239/81

[58] Field of Search ..... 239/79, 81, 83, 84

[56] References Cited

U.S. PATENT DOCUMENTS

| | | | |
|---|---|---|---|
| 1,721,092 | 7/1929 | Saeger, Jr. | 239/81 |
| 1,934,891 | 11/1933 | Taylor | 239/83 X |
| 3,045,278 | 7/1962 | Potter | 239/83 X |
| 3,901,441 | 8/1975 | Kasagi | 239/81 |

FOREIGN PATENT DOCUMENTS

| | | | |
|---|---|---|---|
| 385857 | 1/1933 | United Kingdom | 239/84 |
| 568641 | 4/1945 | United Kingdom | 239/81 |

*Primary Examiner*—John J. Love

*Attorney, Agent, or Firm*—Armstrong, Nikaido, Marmelstein & Kubovcik

[57] ABSTRACT

A metal melt-spraying method for forming deposition film without shrinkage and distortion by jetting out high pressure air to give a jet air stream from a slight gap formed between a spray nozzle and a conical tube placed in said spray nozzle to partition a space in said spray nozzle into two zones, electrically melting metal wires in a low atmospheric pressure zone formed in said jet air stream, driving the resulting molten metal droplets toward said jet air stream by a small air stream, pulverizing said molten metal droplets by said jet air stream into fine particles, simultaneously cooling rapidly said particles to solidify by said jet air stream and then blowing said particles onto a work surface, in which the improvements are that the velocity or volume of the jet air stream is adjusted according to a metal material and melting rate, and that one of two metal wires which are electrodes is made of a hard-to-melt material and is semi-fixed, or only single metal wire is used and is melted by using high frequency. Metal melt-spraying equipments employed for carrying out the method are easy to handle and can yield good quality metal deposition film.

1 Claim, 5 Drawing Figures

METAL MELT-SPRAYING METHOD AND EQUIPMENT

BACKGROUND OF THE INVENTION

The present invention relates to a metal spraying technology where while a metallic wire is being electrically melted, the molten metal is in turn driven by a jet air stream onto the work surface so that a metal deposit or layer is formed on the surface.

The present inventor developed a new metal spraying equipment quite differing from a conventional metal spraying equipment, as disclosed in the U.S. Pat. No. 3,901,441. With conventional equipment, a high velocity jet of air is passed directly over a metal wire melting locus and sprays molten metal droplets forward. Such a process has unavoidable defects. According to the new metal spraying equipment, the incidental defects with the conventional process have been drastically eliminated and an excellent metal deposit or film is successfully obtainable.

This new metal spraying technology is based on a revolutionary technological concept quite different from any conventional metal spraying processes and in which metal wires are melted by low voltage and low current power and the resultant metal droplets are sprayed by relatively low speed air flow. The sprayed film or deposit thus obtained is of excellent quality. The metal spraying equipment as disclosed in U.S. Pat. No. 3,901,441 is summarized as follows:

Passage of a jet air stream propelled at high velocity and a metal wire melting locus are separately provided. That is to say, the equipment is so constructed that the high velocity air stream is blown out of an annular nozzle, which ejection angle is acute to the equipment axis and therefore the jet air stream is gathered to a focus whereafter which the stream is emitted, and that inside the annular air stream or an umbrella as formed by the conical air stream, a metal wire melting device is situated. Inside the umbrella is naturally low pressure or vacuum and by an ejector effect, molten metal is attracted in the jet air stream and mixed with the latter and eventually blown out. In this case, high volume, high density jet air does not pass through the metal wire melting locus as in the conventional process. Therefore a thermal loss and a strong oxidation effect on molten metal do not occur, and a metal melts at its own melting point by small power which is sufficient and no extra thermal calory is required to melt it. Further, no defects are found in this equipment such as turbulence of arcing effect by high velocity jet stream, and oxidation, combustion and deterioration of a metal.

Furthermore, an emphasis is now put on the major characteristics of such a new spraying equipment other than the afore-mentioned. That is to say, nature of the sprayed deposit is essentially quite different from that obtainable as with a conventional means, and no contraction nor distorsion nor interlayer separation is observed with this metal deposit and a quite stable metal layer is obtainable. Even if a thick deposit deemed conventionally impossible or not workable is formed, no peel-off nor distorsion is observed. Probable cause for such big effect is assumed as follows:

Molten metal firstly becomes droplets and is then attracted toward the jet air stream. Then the instant the molten metal droplets enter the jet air stream, they are further pulverized into fine particles each of which having complex protrusions, e.g. dendritic branches. In the next instant, they are instantaneously cooled down by a strong, cool jet air stream and thus these fine particles as having dendrite are solidified and in turn blown with impact onto a work surface. Then the protrusions of a particle get entangled with those of neighbouring fine particles, get squashed, plastically deformed, and solidified in unity to form a metallic deposit or film. This assumption was substantiated by results of recent study.

Even if the above-mentioned assumption may be fundamentally correct, there still remain some points not yet solved and, therefore, in order to obtain good result in all respects, it is not deniable that some skill was required for operation of the equipment.

SUMMARY OF THE INVENTION

In the metal melt-spraying by jetting out high pressure air to form a jet air stream with a slight gap formed between a spray nozzle and a conical tube placed in said spray nozzle to partition a space in said spray nozzle into two zones, electrically melting metal wires in a low atmospheric pressure zone formed in said jet air stream, driving the resulting molten metal droplets toward said jet air stream by a small air stream, pulverizing said molten metal droplets by said jet air stream into fine particles, simultaneously cooling rapidly said particles to solidfy by said jet air stream and then blowing said particles onto a work surface, the improvements wherein:

(i) the velocity of the jet air stream is determined according to a metal material and a melting rate so that the molten metal droplets are pulverized into fine dendritic particles having complicated protrusions and are blown with impact onto a work surface where with the protrusions of neighbouring particles entangled with each other, the particles are plastically deformed to form a metal deposition film on the work surface;

(ii) the case where two metal wires are fed oppositely to each other to form an arc, it tends to yield equipment malfunctioning due to improper arc formation. In order to solve this, (a) one electrode of the arc is comprised of hard-to-melt metal and is semi-fixed, while the other is comprised of meltable or consumable metal wire, and (b) the semi-fixed electrode is finely adjustable;

(iii) A single consumable metal wire is used and fed through the central portion of the spraying equipment and melted by joule heat of high frequency current. The improved metal metal-spraying apparatus designed for metal spray systems where one electrode for arc formation is a semi-fixed, hard-to-melt material or a single metal wire is used and melted by high frequency, are easy to handle and can yield good quality metal deposition film.

It is an object of the present invention to provide a metal spraying method which yields no shrinkage nor distorsion.

A further object of the invention is to provide metal spraying devices which are easy to handle.

These and other objects of the invention will become apparent from the following description and drawings.

DETAILED DESCRIPTION

Figure 1:
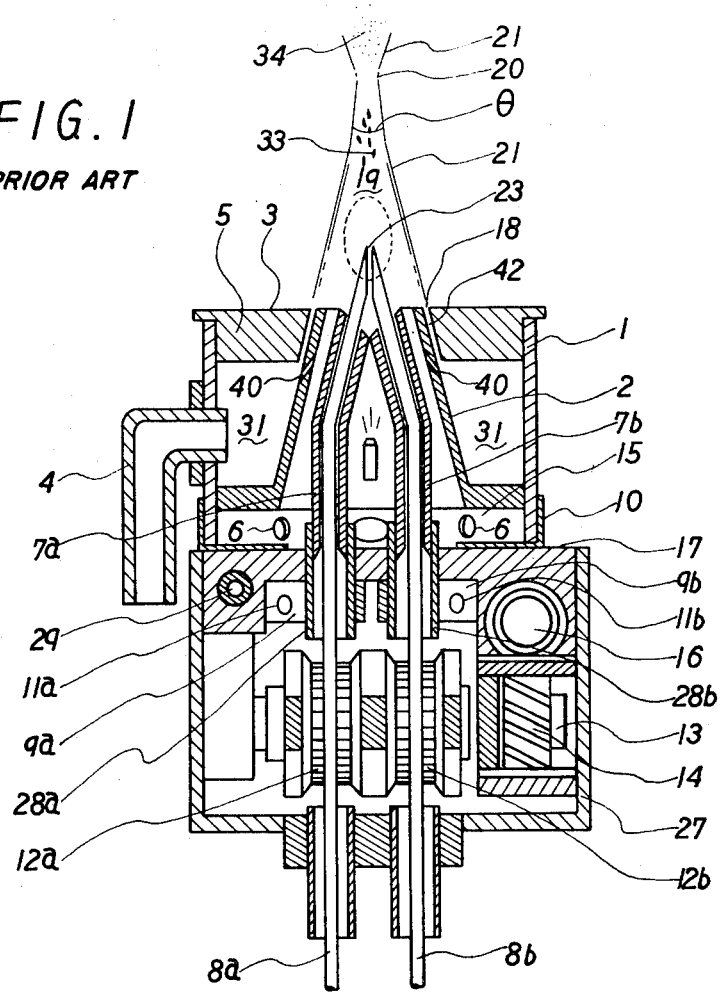
FIG. 1 PRIOR ART
FIG. 1 is a longitudinal section of metal spraying apparatus according to the prior art.

Some of the most prominent points are as follows:

1. Regarding melting itself of a metal wire, while droplets from a metal wire end melted by an electric arc or contact heat or joule heat under a low atmospheric pressure or vacuum in the mechanism which forms an ejector are pulled forward by the ejector action, only the wire portion which has been melted or liquified is separated from the wire end. Although the borderline of the liquid and solid phases is not necessarily clear, the liquidized portion is blown away by agitation of the jet air pressure and the remaining portion is about to be liquified. Therefore, ion emission is very active which forms optimal conditions for continued arcing, and furthermore the slight arc heat which is or contact heat added liquifies promptly the remaining portion, thus facilitating progress in smooth continuous melting.

In order to drive the molten metal droplets forward in the jet air stream, a small gas stream is introduced into the low atmospheric pressure zone. This is attained by introducing air from a ventilation hole connecting the open atmosphere and the low atmospheric pressure zone, or if desired, by introducing a reducing or inert gas. Also, forming of a small jet air stream is of great advantage for this purpose. As a means for forming the small jet air stream, an inclined hole is provided through the wall of a conical tube which is a passage for a high velocity air stream, thus introducing a slight portion of the high velocity stream into the low atmospheric pressure zone and directing said stream toward the metallic wire melting area, in order to drive droplets forward.

2. A second feature of the present invention is that the velocity of the jet air stream or the jet air volume is adjusted according to metal wire materials and/or melting rate. As to the jet air velocity, it is selected from 200 m./sec. to the vicinity of Mach 1. Spray angle (as shown by $\theta$ in FIG. 1) is ranged 20° to 50°, preferably 28° to 35°. Incidentally with larger diameter wire used, a great volume of metal can also be sprayed in a short time span, in which case it is necessary that the jet air flow is relatively increased to provide sufficient forces for pulverization, cooling and transfer of metallic particles.

Adjustment of jet air flow is related to formation of metallic film or coating and for the formation of a good quality coating, pulverization and cooling of the molten metal droplets is essential. Molten metal droplets are pulverized by the jet air flow and the resultant fine particles turn out small metallic particles having complicated dendritic protrusions which are then cooled rapidly to solidify. In the expression of 'dendrite', metallic crystals called whiskers (linear form) are included, and also included is a configuration as formed by irregular tearaway of metal in the molten state, e.g. indefinite configuration similar to that of a small ice particle having extremely complicated form protrusions as assumed or imagined to form in the case of complicated form water droplets made from a wave crest blown off by strong wind are and frozen instantaneously. Therefore a weak wind such as incapable to pulverize the molten droplets is inappropriate for the objective of the present invention. Subsequent to the molten droplets generation and prior to cooling down, the droplets are pulverized by a jet stream force appropriate for specific material of the droplets. The fine particles resulting from pulverization having complicated dendritic protrusion are rapidly cooled to solidify as such. Thus, in the present invention, the velocity of the jet air stream or the jet air volume is selected from 200 m./sec. to the vicinity of Mach 1 according to the metal wire materials and/or melting rate.

3. According to the method where two metal wires are energized to form an arc, heat of which arc melts the wires themselves, sometimes the wires feeding is not undertaken equally with respect to each other, or arc formation is not successful due to the wires distorsion or disformation. In the present invention, in order to eliminate such trouble, improvements have been made such as one of the wires is semi-fixed or a single metal wire is used and heated by high frequency power.

Figure 2:
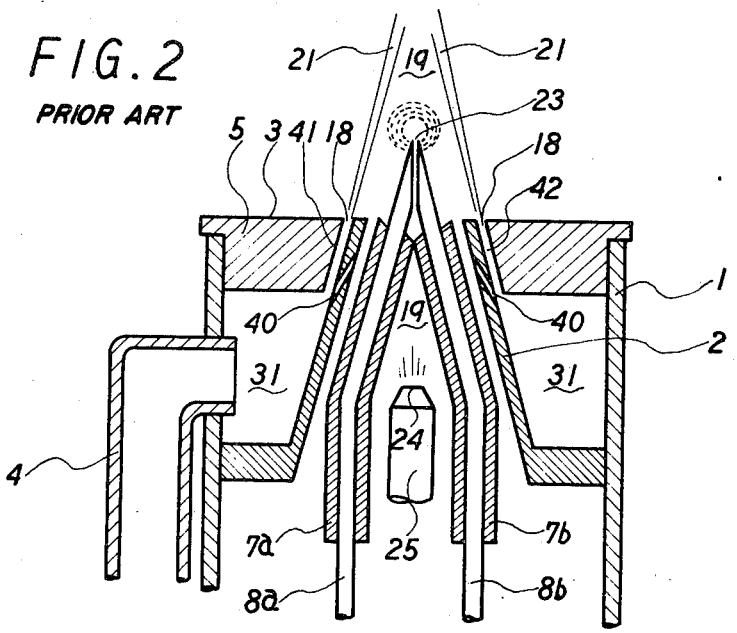
FIG. 2 PRIOR ART
FIG. 2 is an enlarged fragmentary view of a major portion of the prior art device shown in FIG. 1.
Figure 3:
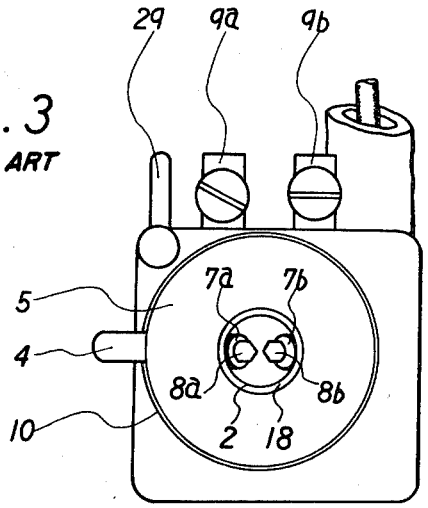
FIG. 3 PRIOR ART
FIG. 3 is a front view of the prior art device shown in FIG. 1.

Referring now to FIGS. 1, 2 and 3, there is shown prior art metal spraying device for carrying out metal melt-spraying.

Numeral 1 is a spray nozzle which is so fitted as to allow mounting and dismounting of same on a metal dish 10 fitted on a circular disc 17 fixed at the foremost end of a case 27 forming the outer housing of the equipment, and also in such manner that the nozzle 1 is mated to allow itself to rotate freely left and right.

Inside the nozzle 1, a truncated conical tube 2 is built so as to partition the cavity in the nozzle 1 into two sections, in and out. Further at the foremost end of the nozzle 1 a jet mouth piece 5 is secured. The mouthpiece is formed by a disc provided at the central portion with a conical hole 41 tapering to open outward. As shown in the figures, the conical tube 2 is so placed in the conical hole 41 that conical angles of both are equal and a narrow annular gap 42 is formed between both and the end of the gap 42 forms an annular jet stream outlet 18.

A high pressure air transfer tube 4 which draws from a separate air compressor (not shown) passes high pressure air via the side wall of spray nozzle 1 into the nozzle, namely, into the vacancy as formed by the conical tube 2 and the spray nozzle 1, i.e. a high pressure air space 31. Therefore, the high pressure air is passed through the annular passage 42 as formed between the external wall of conical tube 2 and the inner wall of conical hole 41 and is forced to jet out via the jet outlet 18. Numeral 15 is a base of the spray nozzle, and the base is provided with a ventilation hole 6 communicating with the open atmosphere and the inside of conical tube 2.

On the other hand, it is so constructed that a pair of guide tubes 7*a*, 7*b* which guide metal wires 8*a*. 8*b* to be melted are mated in a pair of holes 28*a*, 28*b*, which are provided in the disc 17 and can be fixed respectively by bolts 11*a*, 11*b*. Further as shown in figures, the guide tubes 7*a*, 7*b* are so inserted through the conical tube 2 that the foremost end of the guide tube is bent so that they come closer to each other and reach an outer face 3 of the jet mouth piece 5. Therefore, when the metal wires 8*a*, 8*b* are passed through the guide tubes 7*a*, 7*b* to the outside, the wires come closer to or come in an contact with each other in inverted V formation. Through the guide tubes, the wires are connected to the power feed terminals 9*a*,9*b*, which are connected with a power source. The melting location of the metal wires is a little distance from the front of the mouth piece 5 and a little distance nearer to the mouth piece 5 than a focal point 20 as formed by the jet air stream.

Inside the case 27 forming the rear part of the device, toothed rolls 12*a*, 12*b* for feeding the metal wires are provided. The drive of the rolls is effected via a worm wheel 14 on a shaft 13 of the rolls. Numeral 16 is a worm. Further in this part a gas transfer tube 29 is also provided.

Above is a description of the structure of the device which is disclosed in FIGS. 1-3. The apparatus of the device will now be described. When high pressure air is fed into the device from the high pressure air transfer tube 4, the air is first introduced into the high pressue air space 31 and then via the annular passage 42, is jetted out from the jet outlet 18. The jet air stream 21 forms a cone and after converging at the focal point 20, becomes a diverging air stream 21'. A space 19 in the jetting out stream zone and nearer to the piece 5 that the focal point 20 becomes a very low pressure zone, in which zone the melting location of the wires or device therefor is provided. The droplets 33 of molten metal are pulled forth toward the focal point 20 of high velocity jet air stream. Therefore, the molten droplets are not driven forward unless separate air is fed into the space 19, and the air feeding is attainable by introducing air via ventilation hole 6.

The present invention is so constructed that through the wall of conical tube 2 forming the annular passage 42 of high pressure air, inclined holes 40 are provided in the direction pointing toward the melting location of metal wires so that a slight volume of high pressure air is introduced as a jet stream into the low atmospheric pressure zone; and further the molten droplets are driven forth by this small jet air stream. This is one of the features of the present invention, and the inclined holes 40 are also called third jet holes, which have a very small diameter of about 0.5 mm. The provision of the plural holes accounts for smooth spraying.

Some of the materials which make up the metal wires are easily oxidized. In that case, a method may be employed where an inert gas separately provided is jetted out via a gas transfer tube 29 and a gas feed tube 25 from a gas jet outlet 24 (called second jet hole) which opens into the conical tube so that metal wires are shielded in the inert gas when being melted. With this method, the objective of preventing oxidation is attainable with a very small gas consumption.

The essence of the device of the present invention is afore mentioned. Further, a metal wire feeder and power feed terminals are provided on the rear part of the equipment. Also, incidental facilities such as power source, air compressor and gas storage device may be freely designed and employed according to the objective. Now the spraying method, action and features of the device according to the invention are described above.

As aforementioned, high pressure air for spraying molten metal is passed through the annular passage 42 from the high pressure air space 31 and is jetted out from the outlet 18 to form a conical jet air stream, which high pressure air stream does not allow generation of a plasma phenomenon as generated by arc 23 of the metal wires, namely, the conical jet air stream does not pass through the metal melting location.

With conventional methods, a high velocity air stream passes directly through an arc zone, thus cooling the arc zone, which generates a plasma phenomenon due to pinch effect. The method generates ultra-high temperatures and consumes excessively big electric power which leads to overmelting of the metal. In other words, disadvantages are experienced such as power loss and molten droplets production not being not smooth.

However, according to the present invention, there are no such disadvantages. That is to say, according to the present invention, high pressure air does not pass through the metal melting location but detours through another passage, and the molten metal droplets are mixed with the jet air stream by ejector action and at that time pulverization and cooling of the droplets are also effected. In contrast to conventional methods mentioned previously, the invention disclosed herein does not have a high velocity air stream which passes directly through an arc zone, thus cooling the arc zone, generating a plasma phenomenon due to the pinch effect, generating ultra-high temperature and further consuming excessive amounts of current which overmelts the metal. Therefore, there is no disadvantage, such as power loss and unsmooth droplets production. For instance, while conventional methods require electric power of 45 V and 600 A, in the present invention a voltage of less than 17 V and a current of less than 100 A are enough to attain the objective.

To explain the complementarily effect of the third jet hole 40, the small jet air stream to the low atmospheric pressure zone 19 is considerably strong and points to the molten droplets so that the droplets are propelled in the direction to the focal point 20 so that a desirable effect is attainable which is the correct orientation of the start of progress of the droplets as driven by suction or pull. Therefore, it can be said that inclination angle of the inclined holes 40 has a great importance. Further, in consideration of the thin air stream involved, it is also important that the inclined holes are positioned in the vicinity of the arc. Should the position and angle of the holes 40 be inadequate and consequently unable to obtain the above effect and furthermore should they disturb the jet air stream 21, this would be contrary to the objective and would greatly hinder the equipment performance.

As afore-mentioned, in the present invention, the melting location of metal wires and the passage of high pressure air are positioned separately to each other. The melting location is placed in the low atmospheric pressure zone as generated by the jet air stream so that the molten metal droplets 33 are pulled toward the direction of the jet stream. The thus pulled droplets are pulverized, cooled rapidly in order to turn out fine particles 34 having complicated protrusions. The particles are driven by the jet air stream against a workpiece to be sprayed, depositing metal on the workpiece with impact. The fine particles having their protrusions entangled with each other are plastically deformed, squashed and positively deposited in unities to form a film; said film being build-up of fine particles and not cooled while being built up. Therefore, there is no film contraction nor distorsion taking place. According to the present invention, the velocity of the jet air stream is determined by the metal used and its melting rate so that the protrusions of neighbouring fine particles are entangled with each other, the fine particles are plastically deformed and eventually form a metal deposition film onto work surfaces without shrinkage and distorsion. In general, the high pressure air is jetted out from the jet outlet so that the spray angle as shown by $\theta$ in FIG. 1 falls within the range of 20° to 50°, preferably 28° to 35°, and also the jet air velolocity is selected from 200 m./sec. to about Mach 1.

In case the rapid cooling is erroneously or insufficiently effected, or for example in case there is primary error such as spray equipment being positioned too close to work surface, there may be some defective result. However, there is a definite difference between the method of the invention and that of the conventional concept in the built-up structure of sprayed metal film, namely in contrast to the conventional method where molten droplets are jet-sprayed by a high pressure and high temperature air stream, no contraction or distorsion of deposit film takes place in the present invention. Thus the utilization of the present invention encompasses a very wide range of applications.

In the two melt wires system as shown by FIG. 1, two metal wires must be continually melted at an equal rate and therefore be fed in at an equal rate simultaneously. Otherwise, the arc cannot be maintained. For this purpose, the device has an automatic wire feeder to continually form the inverted V by the two wires being fed. However, sometimes due to wire distorsion or due to pollution etc., a correct arc cannot be obtained. As exemplified by this, the melting speed of the metal and adjustments (due to this factor) of metal wire feed rate requires much experience and skill on the part of operator.

Figure 4:
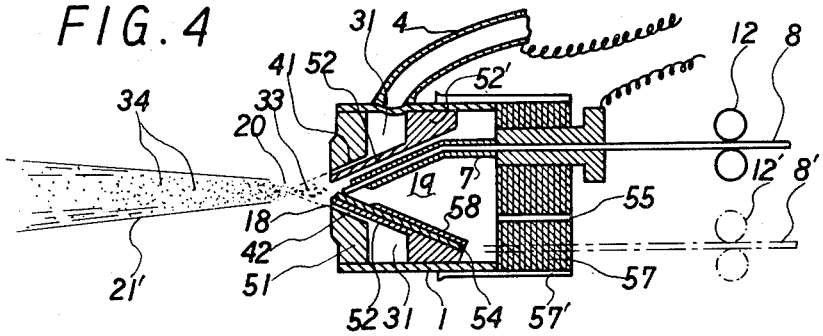
FIG. 4 is a longitudinal section of a semi-fixed electrode type spraying device of the invention.

FIG. 4 shows an improvement in this regard. That is to say, for making the operation easier. One electrode forming arc is comprised of hard to melt material such as tungsten as well a being semi-fixed, while the other electrode is of an ordinary metal wire 8 for melt spraying. The arc is formed by these two electrodes and the melt spraying is effected employing low voltage in similar procedures to those of the aforementioned two melt wires method. Namely it is so constructed that a metal wire feed rolls 12 continually act on the metal wire 8 but not normally on a wire 8' (will act on 8' if required). According to this construction, the difficulties which tend to take place with the two melt wire method, i.e., buckling and vibrations of the metal wire or an improper arc yielded by incorrectly opposing two metal wires due to the wear of guide tubes for metal wires have been solved.

Further as evident from the figure, since a support 58 for thick semi-fixed electrode 54 is affixed on inner wall of a spray nozzle 1 which is constructed rotatable, fine adjustment on arc formation is effectable by manually turning the nozzle.

Furthermore, when an ordinary metal wire in lieu of the fixed electrode 54 is threaded in and feed rolls 12' are operated, this makes a two melt wires system where one electrode is supported in a finely adjustable support. Arc adjustment is effectable during the operation, and highly efficient and good product quality is obtainable. This feature allows arc adjustment at any time during operation and consequently uniform quality of the deposition film is obtainable, thus overcoming many defects with conventional equipment.

The structure of a semi-fixed electrode type melt spray device is described with reference to FIG. 4. A spray nozzle 1 is secured in a freely rotatable manner inside a cylindrical case 57' which is assembled in unity with the outside of equipment base 57. At the front of the nozzle 1, a jet mouth piece 51 having a conical hole 41 is fitted, and on the inner wall of the nozzle, a base 52' having a hollow conical inner nozzle 52 is solidly affixed.

Foremost end portion of inner nozzle 52 is placed in the conical hole 41 of the jet mouth piece 51 so that both the inner wall of hole 41 and the outer wall of the end portion of nozzle 52 are facing each other with a slight gap 42 in between while inclination angles of the both are equal. Consequently the foremost end of the annular passage 42 so formed makes up a jet spray hole 18.

Further on the inner wall of inner nozzle 52, support 58 for the electrode 54 made of a hard to melt material, e.g., tungsten wire or rod etc. is fitted. Further it is so constructed that inside the inner nozzle 52, a guide tube 7 for the metal wire 8 is fitted bent as shown in the figure. The foremost end of the metal wire being threaded through the guide tube then forms an inverted V with the fixed electrode eventually to form an arc or to contact with each other to generate heat.

With this method, only metal wire 8 is melted and jet sprayed. In other respects, this is approximately same with the method per FIG. 1. Numeral 4 is a high pressure air introduction pipe, and numeral 55 is a ventilation hole communicating the low atmospheric pressure zone 19 with the outer atmosphere. The hole 55 may also be connected with an inert gas container (not shown). Numeral 31 is a high pressure air space and 12, 12' are metal wire feed rolls.

As aforementioned, with the equipment, one electrode is fixed to the support with the assembly being wholly rotatable wherefore it is titled "semi-fixed type". The arc is easily formed due to the use of an electrode which is semi-fixed and not self-consuming. Furthermore, the fixed electrode itself is fixed to the spray nozzle 1, and by rotating the nozzle 1, arc formation is finely adjustable thus allowing optimal adjustment of arc conditions during operation. Consequently the operational efficiency and deposition film quality obtainable with the device disclosed yields improved and unexpected results over conventional equipment. Also, since the volume of cool jet air stream is much larger, the thermal quantity of droplets yielded from single metal wire is better, and the cooling effect is far better than two melt wires system. Therefore, the semi-fixed type spray method is particularly effective for metals having high melting points.

Incidentally the effect that is created by high pressure air being jetted out from jet spray hole 18 and by the molten metal droplets being pulled by the jet air stream and being simultaneously pulverized, cooled and blown thereby, is the same as afore-mentioned.

Further with the semi-fixed electrode type equipment, another melt metal wire may be threaded through the fixed electrode support 58, then fed by rolls 12' and used for a two melt wires system. Also in this case, the arc is finely adjustable wherefore it is very easy to operate or consequently effect an improvement in efficiency and deposition film quality. With regard to the difference between the single wire system and the two melt metal wires system; with the former, when the metal volume to be melt sprayed is small, it is adequate for the formation of a fine dense deposition film as well for melt spraying of expensive precious metals, meantime the latter is adequate for any applications.

Although it is normal practice that both electrodes are used to generate an arc for yielding heat, the arc is not necessarily to be used for this purpose but both electrodes may be contacted with each other and the metal wire may be melted by the heat yielded by the contact. In that case since melting can be proceeded without heating the wire much above the metal melting point, such disadvantages as metal oxidation, combustion and overheating are decreased while faster cooling is attainable, thus the utility value of the equipment is great. With a conventional high temperature melt spray system, such a method cannot be employed.

Figure 5:
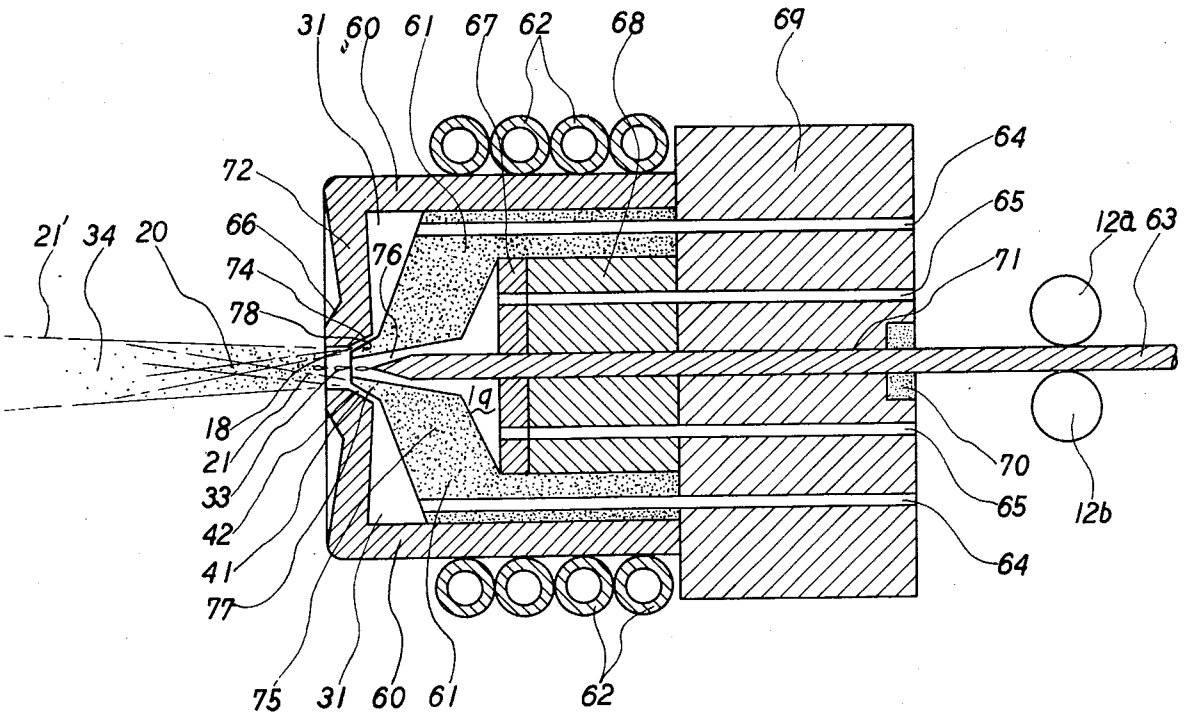
FIG. 5 is a longitudinal section of a single consumable wire type spraying device of the invention.

Nextly another improved system where only one melt spray metal wire or rod is used and melted by high frequency current is described below:

In FIG. 5, numeral 60 is an outer nozzle, which whole configuration is like a cup laid as shown in the figure. The bottom wall 72 of the cup has a convexity 66 at its axial center where a conical hole 41 tapering open outward is provided. Inside the nozzle 60, an inner nozzle 61 made of an electro-magnet is provided.

The inner nozzle 61 is also alike a cup where wall 75 is protruded outward and at its axial center a steep protrusion 77 is provided. The center has a cavity which makes up a chamber 76 wherein the foremost end of a metal wire 63 is positioned. The protrusion 77 is placed inside the conical hole 41 at the axial center of the outer nozzle 60 in such a way that a narrow gap 42 is made between an inner face 74 of the conical hole and an outer face 78 of the protrusion. The gap 42 is a passage for high pressure air.

The passage 42 is annular and its extremity forms an annular jet outlet 18. Therefore, when high pressure air from a separately provided air compresser (not shown) is fed into the device via an air feed tube 64, the high pressure air is conically jetted out from the jet outlet 18 via a high pressure air room 31 and the passage 42, and forms a jet air stream 21 converging to a focal point 20 and then deverging to form a jet air stream 21' in a similar manner as above-mentioned.

Inside the inner nozzle 61, an annular hard electrical insulator 67 and its support 68 are mated as shown in the figure. Thus the front portion of the spray device consists of a triple walls structure. On the outer perifery of the outer nozzle 60 at a position where the outer nozzle contact with the inner nozzle, i.e. electromagnet, a high frequency electric coil 62 is wound as shown in the figure, to melt the metal wire 63 by high frequency. To the rear of the front portion, a rear portion 69 is connected, thus comprising the basic device.

At the central part of the rear portion, an annular insulator 70 is secured. Furthermore, the high pressure air feed tube 64 is provided through the front and rear portions as shown in the figure and narrow ventilation hole(s) 65 communicating a low atmospheric pressure zone 19 with the open air.

The metal wire 63 is threaded through a wire passage bore 71 provided at the axial center of the device and so fed by rolls **12*a*, 12*b* that the foremost end of the wire reaches the chamber 76**.

As for functions of this improved equipment, high pressue air jet mechanism is similar to that aforementioned, but since the metal wire used is single and the joule heat by high frequency current is utilized for melting the wire, the operation is now very simple and easy. That is to say, when high frequency is supplied to the coil 62, the foremost end of the single metal wire 63 positioned at the axial center of the equipment is melted from its surface by joule heat of secondary high frequency current into droplets 33, which are then pulled toward the jet air stream 21. Since the foremost end of the metal wire gradually continues to be melted by joule heat, the melt spraying is continued by continually feeding in such wire length corresponding to the molten volume. The functions where the molten droplets 33 are pulverized into fine particles 34 having complicated protrusions, cooled and blown onto a work surface to deposit metal film onto the surface are similar to those the aforementioned two systems, and the properties of fine particles and deposit film are also the same as the foregoing two systems.

However this device is particularly easy to handle. That is, this single melt wire system eliminates completely the need for the inverted V formation by two metal wires ends for arc establishment and the adjustment required with conventional two wire system and the semi-fixed electrode system. In comparison with the foregoing two systems, this system using a single metal wire has a particular feature that even a beginner can promptly and efficiently obtain a good quality metal deposition film which has no shrinkage and distorsion.

What is claimed is:

1. A metal spraying apparatus for producing a deposited film without shrinkage or distortion, said apparatus comprising:

(a) an outer casing nozzle, said nozzle having a frustro-conical shaped hole formed in one wall;

(b) an inner nozzle means positioned within said outer casing nozzle, said inner nozzle means extending into said frustro-conical shaped hole wherein a small annular gap is formed between said hole and said inner nozzle means;

(c) a metal wire having an end positioned in said inner nozzle means, said inner nozzle means being positioned between said metal wire and said gap;

(d) a high frequency electric coil positioned on the exterior of said outer nozzle, said coil being capable of acting in conjunction with said inner nozzle such that said inner nozzle acts as an electromagnetic core surrounded by said coil, such that said coil and said core form a heater means, positioned with respect to said metal wire for heating an end of said metal wire in said inner nozzle means, said heater means being formed such that said metal wire is melted by energy directed to said end of said wire by said inner nozzle, thereby forming droplets;

(e) high pressure air jet means for jetting air under high pressure through said gap, said jet means being positioned so as to direct pressurized air through said apparatus such that said pressurized air is directed through an area wherein said pressurized air is free from exposure to any concentration of said directed energy of said inner nozzle so that said air remains unheated as it passes through said apparatus.

* * * * *